United States Patent [19]

Thompson

[11] Patent Number: 4,508,272

[45] Date of Patent: Apr. 2, 1985

[54] HOSE END SPRAY NOZZLE

[76] Inventor: Lincoln Thompson, 26 Carriage Rd., Cheshire, Conn. 06410

[21] Appl. No.: 425,503

[22] Filed: Sep. 28, 1982

[51] Int. Cl.[3] ..... B05B 7/30

[52] U.S. Cl. ..... 239/318; 222/630; 222/464; 137/218; 137/891

[58] Field of Search ..... 222/630, 464; 239/310, 239/318, 316; 137/893, 894, 218, 891-892

[56] References Cited

U.S. PATENT DOCUMENTS

| | | | |
|---|---|---|---|
| 2,728,609 | 12/1955 | Pollock et al. | 137/893 |
| 3,186,643 | 6/1965 | George et al. | 137/218 X |
| 3,204,875 | 9/1965 | Langstroth | 239/318 |
| 3,212,716 | 10/1965 | Mills et al. | 239/318 |
| 3,445,067 | 5/1969 | Sheldall | 137/893 X |
| 3,797,747 | 3/1974 | Buzzi et al. | 239/318 X |

FOREIGN PATENT DOCUMENTS

| | | | |
|---|---|---|---|
| 689303 | 3/1953 | United Kingdom | 137/892 |

*Primary Examiner*—Charles A. Marmor

[57] ABSTRACT

A device for mixing and dispensing fluids comprising a head unit having a flow passage provided with a converging portion for receiving a first liquid stream from a pressurized source A hollow pipe rotatably mounted in the head unit is provided with a suction port through which a second liquid may be introduced into the flow passage downstream of the converging portion. The hollow pipe partially projects into the flow passage thereby forming a restriction in the flow passage, a low pressure region thus being formed downstream of the suction port. A chamber may be provided in the flow passage downstream of the converging portion thereof and upstream of the suction port. The chamber is vented to atmosphere thereby providing a vacuum break so as to prohibit the second liquid from being drawn back into the source of the first liquid upon terminating the flow of the first liquid stream.

11 Claims, 5 Drawing Figures

HOSE END SPRAY NOZZLE

BACKGROUND OF THE INVENTION

The present invention relates to a device for mixing and dispensing fluids and, more particularly, an aspiration type device for mixing and dispensing fluids having an improved suction control mechanism.

Known prior art devices for mixing a liquid into a stream of water or the like suffer from a number of serious disadvantages. In "side hole aspirators" where a restricted metering passage is positioned in the sidewall of the mainstream passage as, for example, shown in U.S. Pat. No. 3,894,662, there is a problem with clogging of the metering passage. Further, without the addition of active valve type devices, which create resistance to flow and thus minimize range, the known aspirators fail to pass the so-called "California Test" which insures against the liquid which is being mixed into the stream of water being sucked back into the water source. In addition, known devices either fail to permit adequate regulation of the proportion of additive liquid or include complicated valving mechanisms which increase the cost of the device. Naturally, it is highly desirable to provide a device for mixing and dispensing fluids in desired amounts without the need of complicated valving mechanisms. Additionally, known aspirator type spray devices project a comparatively weak stream because of inherently small bores and thus cannot be employed to spray moderate to large size shade and fruit trees.

Accordingly, it is a principal object of the present invention to provide a device for mixing a liquid into a stream of water in a controlled manner while providing a strong output stream.

It is a particular object of the present invention to provide a device for mixing and dispensing fluids which insures against back flow to the source of the main fluid stream.

It is a further object of the present invention to provide a reliable device for mixing and dispensing fluids which is free from small openings and is of uncomplicated construction.

Further objects and advantages of the present invention will appear hereinbelow.

SUMMARY OF THE INVENTION

In accordance with the present invention the foregoing and other objects and advantages are readily obtained.

The present invention comprises a head unit for mixing and dispensing fluids. In accordance with the present invention, the flow passage in the head unit is provided with a flow passage having a converging portion. A source of a carrier or main liquid is coupled to a passage inlet located upstream of the convergent portion whereby the velocity of the liquid will be greater downstream of the converging portion of the flow passage and a low pressure area will be created downstream of the converging portion of the flow passage. A hollow pipe, closed off at one end, is rotatably mounted in the head unit. This hollow pipe is provided with a side port through which a second liquid is introduced into the flow passage downstream of the converging portion thereof. The hollow pipe partially projects into the flow passage thereby forming an additional flow restriction in the flow passage so as to further decrease the pressure immediately downstream of the hollow pipe. The low pressure, in combination with the rush of the carrier liquid stream past the side port, results in a pumping action which draws the second liquid through the port and into the flow passage. The amount of the second liquid drawn into the flow stream is regulated by rotating the hollow pipe to simultaneously vary the size of the port as well as its location with respect to the additional flow restriction.

In a preferred embodiment of the present invention, a chamber is provided in the flow passage downstream of the inlet and upstream of the side or suction port. The chamber is vented to atmosphere thereby providing a vacuum break so as to prohibit the second liquid from being drawn back into the source of the carrier liquid upon terminating the flow of the carrier liquid stream. An on-off valve may be provided in the flow passage upstream of the port. In addition, the flow passage may be provided with means for varying the rate of flow of the carrier liquid stream.

By way of the present invention, diverse liquids are readily mixed and dispensed in a controlled manner. The mechanism of the present invention as exemplified by the preferred embodiment insures against back flow to the source of the carrier liquid stream.

DETAILED DESCRIPTION

Figure 1:
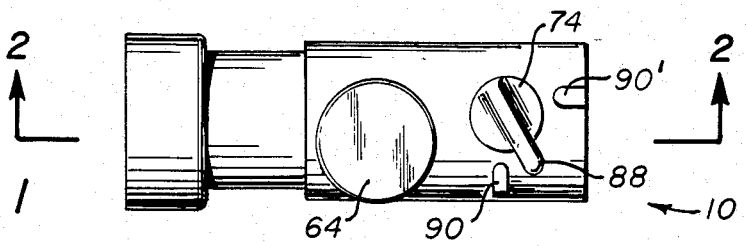
FIG. 1 is a top view of the preferred embodiment of apparatus in accordance with a first embodiment of the present invention.

For purposes of discussion, the present invention is illustrated and will be described as being applied to a container for adding insecticide to a stream of water flowing from a garden hose. It should be appreciated that the device of the present invention has other applications without departing from the principles described herein.

Referring to the drawings, the apparatus for mixing and dispensing fluids in accordance with the present invention comprises a head unit, indicated generally at 10, having a threaded cap member 12 provided with internal threads 14 for receiving the externally threaded neck portion 18 of an insecticide container 16. Head unit 10 is further provided with a conventional connector comprising female cap portion 20 having a rubber washer 22 positioned therein for receiving, in a sealed manner, the externally threaded male connector, not shown, at the end of a garden hose. The cap portion 20 is rotatably mounted on a tube 24 provided with flanges 26 which hold the cap 20 in place. Tube 24 is secured to the body of the head unit 10 by any suitable means such as a press fit or the like.

Figure 3:
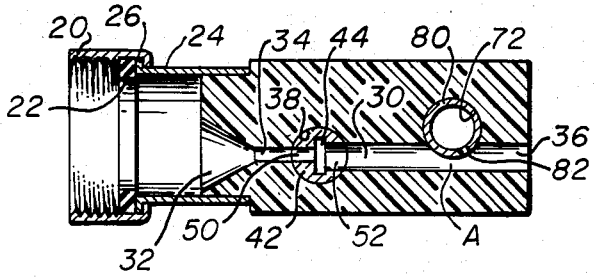
FIG. 3 is a sectional view taken along lines 3—3 of FIG. 2.
Figure 4:
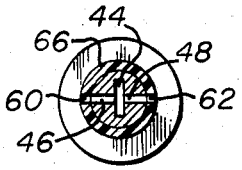
FIG. 4 is a sectional view taken along lines 4—4 of FIG. 2.
Figure 2:
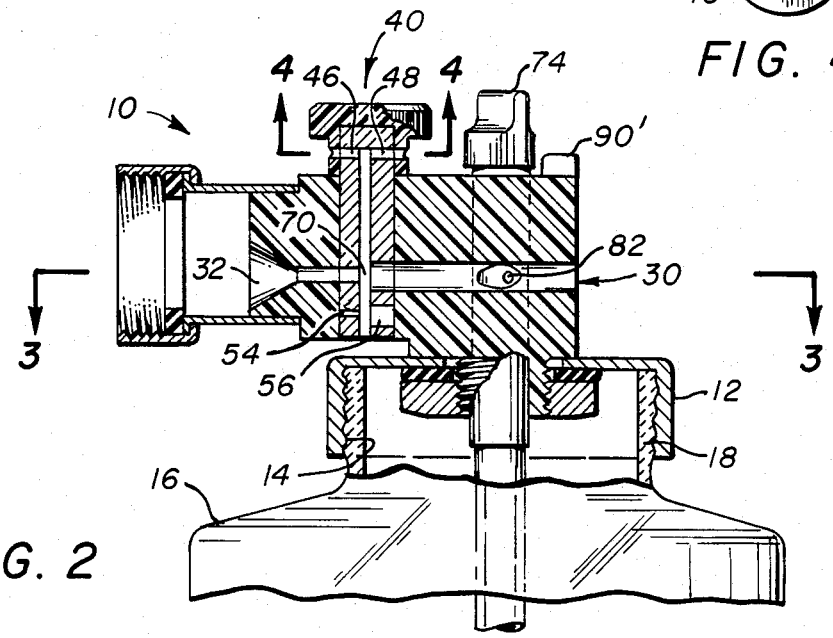
FIG. 2 is a partial sectional view of the apparatus of FIG. 1 taken along line 2—2 and showing the apparatus attached to a container.

Referring to FIGS. 2 and 3, head unit 10 is provided with a through flow passage 30 having a first converging portion 32, a second portion 34 of a first diameter and a third portion 36 having a second diameter. In accordance with a preferred embodiment of the present invention, a bore 38 is provided on an axis oriented transversely with respect to flow passage 30. Bore 38 separates portion 34 of flow passage 30 from portion 36. Telescopically received in bore 38 in a rotatable manner is an on-off valve, indicated generaly at 40, which comprises a rotatable valve member 42 having a rectangular slot 44 running along the axis thereof. Slot 44 intersects a plurality of passages 46–48, 50–52, and 54–56 provided in valve member 42. Passage sections 46 and 48 are of the same diameter and communicate slot 44, and thus flow passage 30, to the ambient atmosphere via ports 60 and 62 (FIG. 4) provided in the sleeve 66 of knob 64 which is fixedly secured to valve member 42. Slot 44 is also preferrably in direct communication with the ambient atmosphere at the end thereof disposed oppositely from knob 64. Be venting slot 44 to atmosphere a vacuum break is created which prohibits insecticide from being drawn back into the water system due to negative pressure upon terminating the flow of the water. Passages 50–52 and 54–56 selectively communicate portion 34 of flow passage 30 with portion 36. Valve member 42 of on-off valve 40 is both rotatably mounted in bore 38 and movable in a direction perpendicular to the axis of flow passage 30 for selectively communicating either passage 50–52 or passage 54–56 with portions 34 and 36 of flow passage 30 to provide two different flow rates. Passage portions 52 and 56 are equal in size to portion 36 of flow passage 30 and are larger in size than the aligned respective upstream portions 50 and 54 so as to accommodate any expansion or divergence of the stream of water as it "jumps" the gap 70 formed by slot 44 so as to insure against water leakage into slot 44. Gap 70 should not exceed ¼ inch length and should preferrably be about 3/32 of an inch in length. The cross-sectional area of slot 44 should preferrably be between 0.03 and 0.06 square inches. Passage portion 50 will typically be equal in cross-sectional area to portion 34 of main passage 30 while passage portion 54 will be of smaller cross-sectional area than portion 34. As an alternative construction, slot 44 may be formed in the body portion of head unit 10 and a separate on-off valve provided upstream of slot 44.

In accordance with the principals of the present invention, a hollow pipe 80, closed at its upper end, is rotatably mounted in a bore 72 in head unit 10 by means of knob 74. Hollow pipe 80 communicates with the insecticide in container 16 for delivering insecticide to portion 36 of flow passage 30 via a side port 82 in a manner to be described in detail hereinbelow. The hollow pipe 80 projects part way into portion 36 of flow passage 30 so as to define a restriction A thereby increasing the velocity of the stream while at the same time producing a partial vacuum in the area of port 82. The distance pipe 80 projects into passage portion 36 should not exceed 0.4 the diameter of passage 36 and preferably not more than one-third the passage diameter. Hollow pipe 80 is movable between a "closed" position and a "full open" position where the full area of the port 82 is exposed to the pressure prevailing in passage 36 downstream of restriction A. It is critical that the port 82 always face entirely in the downstream direction, i.e., that the outwardly disposed edge thereof is always downstream of the throat of restriction A formed by hollow pipe 80. The partial vacuum resulting from the flow past restriction A in combination with the rush of water past port 82 results in a pumping action which draws the insecticide through the port 82 and into portion 36 of flow passage 30. It is to be particularly noted that the above-described construction permits the use of a suction port 82 of relatively large size. The larger the suction port becomes, the larger will be the suction rate. In actual practice, the suction port of a spray device in accordance with the present invention will have a cross-sectional area which is several times the size of those employed in prior art side hole aspirators.

Figure 5:
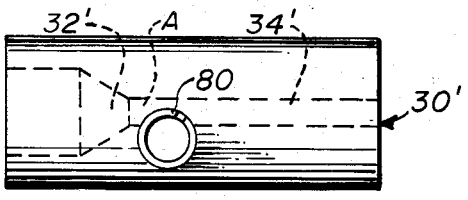
FIG. 5 is a sectional view of an alternate embodiment wherein the flow passage is in the form of a venturi.

FIG. 5 shows an alternate embodiment of the present invention wherein flow passage 30' is in the form of a venturi having a first converging portion 32' and a second straight portion 34'. Hollow pipe 80' is mounted and projects into portion 34' in the same manner as discussed with reference to FIGS. 1–4. While on-off valve 40 is not shown in the embodiment of FIG. 5 it should be appreciated that same could be incorporated downstream of portion 32' and upstream of pipe 80' in the same manner as discussed above with regard to FIGS. 1–4.

In operation of the embodiment depicted in FIGS. 1–4, head unit 10 is secured to a source of pressurized liquid such as water by means of connector 20 while cap 12 is secured to container 16 containing an insecticide. With on-off valve 40 in the position shown in FIGS. 2 and 3, water entering tube 24 is directed to converging portion 32 of flow passage 30 where the velocity of the stream is increased and a low pressure is created. The stream of water passes through portion 34 of flow passage 30 into passage portion 50 formed in valve body 42, across gap 70 formed by slot 44 to passage portion 52 and thence to portion 36 of flow passage 30. In the event a lower flow rate is desired, valve body 42 may be positioned so as to communicate passage portions 54 and 56 with portions 34 and 36 respectively of flow passage 30. In addition, by rotating valve body 42 ninety degrees, the flow of water can be shut-off. A stream of water flowing through portion 36 of flow passage 30 will be discharged from unit 10 at high velocity. Flow restriction A formed by hollow pipe 80 further decreases the pressure in the area downstream of the restriction.

Knob 74, and thus tube 80, are rotated to align a marker 88 on the knob with a gradation on the exterior of the body of the device so as to achieve the desired suction rate as determined by the rotational position of port 82. The low pressure area created by restriction A in combination with the rush of water past the port results in a pumping action which draws the insecticide through the port 82 and into flow passage 30. The suction rate for drawing the insecticide is controlled by simultaneously controlling the area of port 82 exposed to the flow passage 30 and the location of the port with respect to the restriction A. A stop 90 is provided on the device, for cooperation with marker 88, to prevent port 82 from being rotated to an upstream facing portion.

In the event that a negative pressure is created upstream of converging portion 32 or gap 70, slot 44 and passages 46 and 48 in valve member 42 cause the flow passage to be vented to atmosphere thereby providing a vacuum break and prohibiting back flow of liquid to the water source.

By way of the present invention, diverse fluids are mixed and dispersed in a controlled manner while insuring against back flow to the water source.

It is to be understood that the invention is not limited to the illustrations described and shown herein, which are deemed to be merely ilustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. Apparatus for selectively mixing fluids comprising:

a body, said body defining a first fluid passage which extends therethrough, said first fluid passage including a converging portion and a first constant diameter portion located downstream of said converging portion;

coupling means for connecting a source of first pressurized fluid to said body, said coupling means delivering the pressurized fluid to said first fluid passage whereby the velocity of said first fluid will be increased during flow through said converging portion prior to flow through said first constant diameter portion; and tube means rotatably mounted within said body, said tube means being closed at a first end and extending outwardly from said body to an open second end, said tube means intersecting said first constant diameter portion of said first fluid passage and extending partially into said constant diameter passage portion from a side thereof, said tube means thus forming a restriction in said first fluid passage, a low pressure area being created downstream of said restriction, said tube means being provided with a port extending through the wall thereof to establish communication between said first fluid passage and the interior of said tube means whereby the low pressure area downstream of said tube means may be placed in communication with the second end of said tube means to thereby establish a flow of a second fluid through said tube means into said first fluid passage for mixing with said first fluid, the rate of flow of the second fluid being controllable by rotation of said tube means to vary the area of said port which is in communication with said first fluid passage.

2. The apparatus of claim 1 wherein said tube means includes a constant diameter tube which extends into said first constant diameter portion of said first fluid passage a distance which does not exceed forty percent of the diameter of said first constant diameter portion.

3. The apparatus of claim 1 further comprising:

means defining a chamber disposed downstream of said converging portion of said first fluid passage and upstream of said tube means, the first fluid passing through said chamber.

4. The apparatus of claim 3 wherein valve means is disposed within said chamber for controlling the flow of said first fluid.

5. The apparatus of claim 3 wherein said chamber is vented to the ambient atmosphere.

6. The apparatus of claim 5 wherein said tube means includes a constant diameter tube which extends into said first constant diameter portion of said first fluid passage a distance which does not exceed forty percent of the diameter of said first constant diameter portion.

7. The apparatus of claim 1 further comprising:

valve means mounted in said body, at least a portion of said valve means being disposed in said first fluid passage downstream of the converging portion thereof and upstream of said tube means, said valve means being operable to control the flow of said first fluid through said first fluid passage.

8. The apparatus of claim 7 wherein said first fluid passage further comprises:

a second constant diameter portion disposed between said converging portion and said first constant diameter portion, said second constant diameter portion having a smaller diameter than said first constant diameter portion, said valve means selectively establishing fluid communication between said first and second constant diameter passage portions.

9. The apparatus of claim 8 wherein said valve member defines a rotatable portion of said first fluid passage and wherein said apparatus further comprises means for venting said rotatable first passage portion to the ambient atmosphere.

10. The apparatus of claim 5 wherein said first fluid passage further includes a second constant diameter portion, the diameter of said second constant diameter portion being less than the diameter of said first constant diameter portion, said first and second constant diameter portions being in communication via said chamber.

11. The apparatus according to claim 6 wherein said first fluid passage further includes a second constant diameter portion, the diameter of said second constant diameter portion being less than the diameter of said first constant diameter portion, said first and second constant diameter portions being in communication via said chamber.

* * * * *